United States Patent [19]

McGillis et al.

[11] Patent Number: 4,872,668

[45] Date of Patent: Oct. 10, 1989

[54] MULTIDIRECTIONAL EXERCISER

[75] Inventors: Joseph P. McGillis, 827 Rosemoss Rd. #10, Deer Lodge, Mont. 59722; Howard G. Fly, Ovando, Mont.

[73] Assignee: Joseph Patrick McGillis, Deer Lodge, Mont.

[21] Appl. No.: 98,021

[22] Filed: Sep. 16, 1987

[51] Int. Cl.[4] ..... A63B 21/24

[52] U.S. Cl. ..... 272/130; 272/71; 272/93; 272/129; 128/25 R; 434/254

[58] Field of Search ..... 272/93, 129, 130, 71; 128/25 R; 434/254

[56] References Cited

U.S. PATENT DOCUMENTS

| | | | |
|---|---|---|---|
| 1,966,448 | 7/1934 | Kabisius | 434/254 X |
| 3,074,716 | 1/1963 | Mitchell et al. | 272/71 |
| 3,451,271 | 6/1969 | Knoblauch | 73/379 |
| 3,465,592 | 9/1969 | Perrine | 73/379 |
| 3,587,319 | 6/1971 | Andrews | 272/130 X |
| 3,912,265 | 10/1975 | Muir | 272/130 |
| 4,063,726 | 12/1977 | Wilson | 272/129 X |
| 4,235,437 | 11/1980 | Ruis et al. | 272/130 X |
| 4,355,633 | 10/1982 | Heilbrun | 128/25 R |
| 4,478,412 | 10/1984 | Muir | 272/130 |
| 4,610,448 | 9/1986 | Hill | 272/93 |
| 4,629,185 | 12/1986 | Amann | 272/130 |
| 4,640,268 | 2/1987 | Roberts | 128/25 R |
| 4,768,778 | 9/1988 | Thomas, Jr. | 272/93 |

FOREIGN PATENT DOCUMENTS

| | | | |
|---|---|---|---|
| 0962709 | 2/1975 | Canada | 272/71 |
| 8601420 | 3/1986 | Hungary | 434/254 |

*Primary Examiner*—Richard J. Apley
*Assistant Examiner*—Joe H. Cheng
*Attorney, Agent, or Firm*—Wells, St. John & Roberts

[57] ABSTRACT

An isokinetic multidirectional exerciser utilizes an articulated boom mounted to a supporting base for pivotal movement relative to the base. The articulated boom preferably uses two arms which are pivotally connected. Relative movement between the boom arms and the base is individually resisted by fluid devices operatively connected between the members that move relative to one another during use of the exerciser. Each fluid device includes a resistive closed fluid path that is adjustable to vary the range of resistance that will be encountered during such movement. Provision is made for independent adjustment of resistance in opposite directions of movement of the exerciser members. This is accomplished by use of opposed check valves having individual bypass paths and flow control valves.

63 Claims, 10 Drawing Sheets

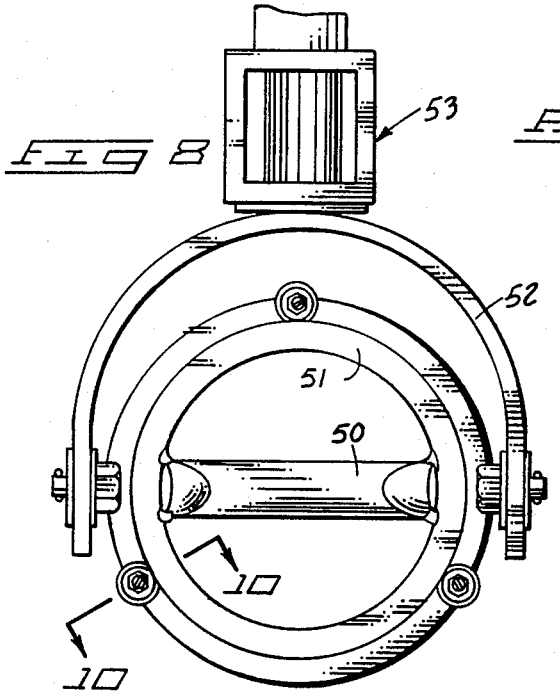
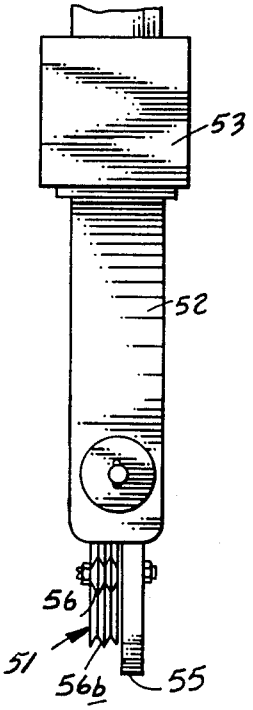
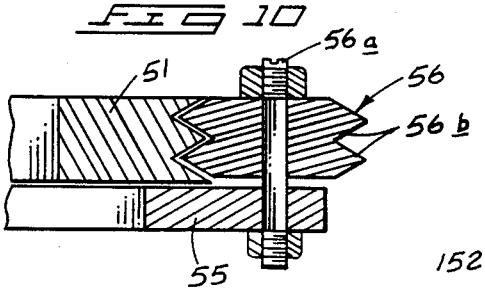
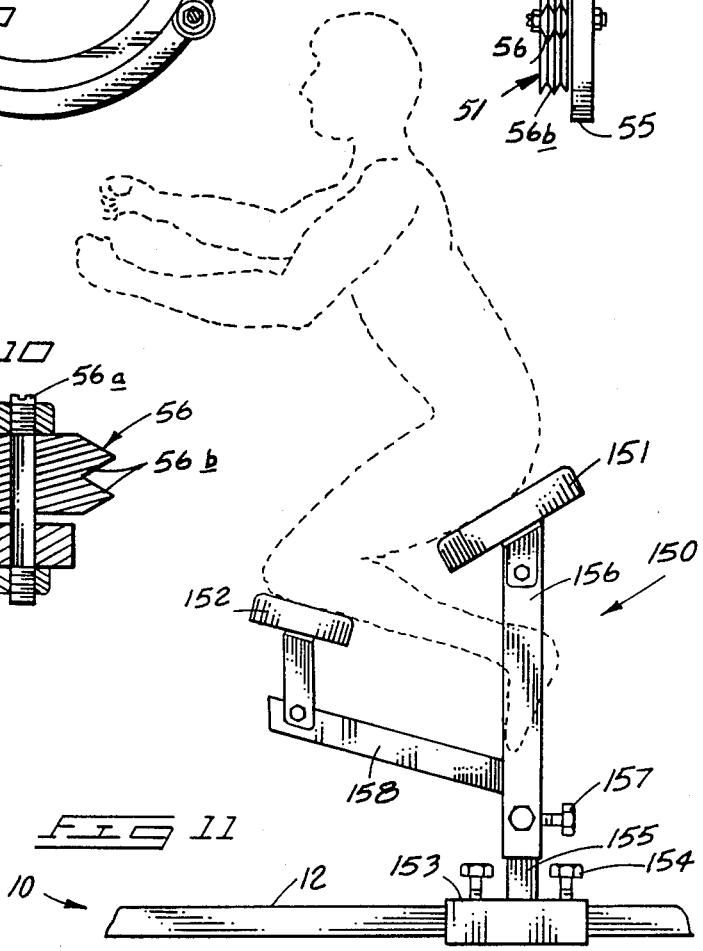
FIG 11

FIG 15
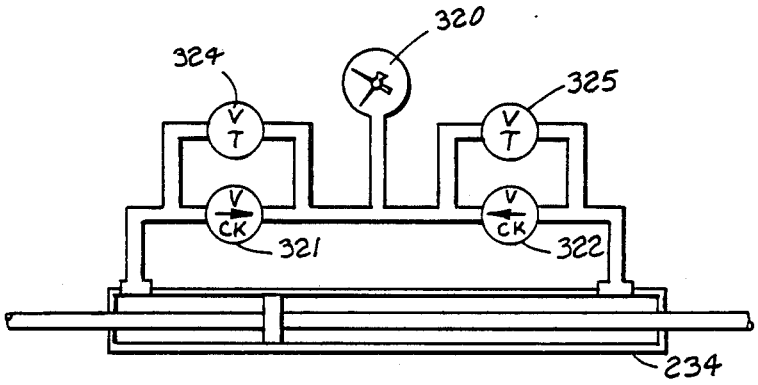
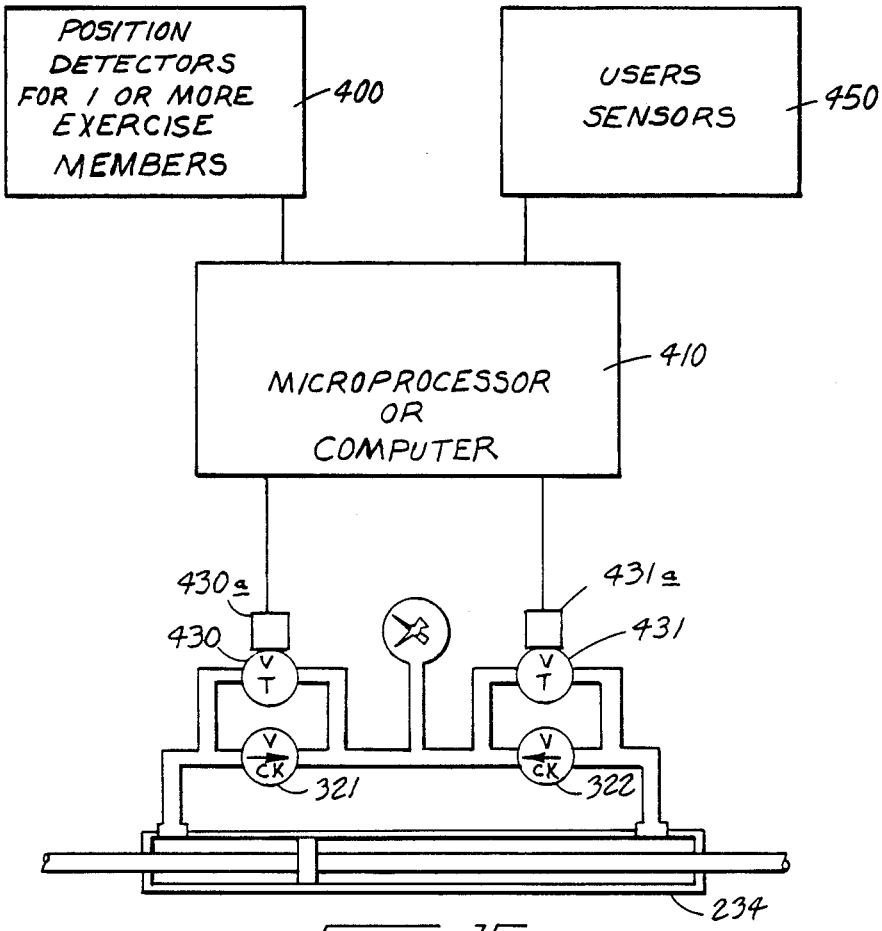
FIG 16

MULTIDIRECTIONAL EXERCISER

FIELD OF THE INVENTION

The field of this invention is exercisers which resist bodily movement of a user for muscular development purposes.

BACKGROUND OF THE INVENTION

Prior art exercising apparatus have not been successful in resisting motion of the user in all directions. Instead the typical exercising device resists linear or pivotal motion in one dimension or in a plane. Swimmers in particular have long needed an exercise apparatus which allows faster development of the complex arm motions used in swimming strokes such as the butterfly, breaststroke and others. Prior art exercisers have not successfully addressed these needs. Prior art exercise apparatus have also failed to provide adjustability in the resistive force associated with different directions of travel for complex motion within a plane or in all directions. There also remains a need for exercise devices capable of these relatively complex resistive motions which also are easily adjustable in resistance and sufficiently balanced in structure so that various starting positions for different exercises all have non-biased or neutralized forces until motion is begun.

BRIEF DESCRIPTION OF THE DRAWINGS

Preferred embodiments of the invention are illustrated in the accompanying drawings, in which:

FIG. 8 is a plan view of a hand grip assembly;

FIG. 9 is a side view of the assembly shown in FIG. 8;

FIG. 10 is an enlarged fragmentary sectional view taken along line 10—10 in FIG. 8;

FIG. 11 is a fragmentary side elevation view showing the front end of the base and a user support structure adjustably connected thereto;

FIG. 15 is a diagrammatic view of a resistive cylinder assembly and associated bidirectionally adjustable fluid resistance elements as used in the embodiment of FIG. 12;

FIG. 16 is a further diagrammatic view of a further alternative control system useful with the embodiment of FIG. 12;

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
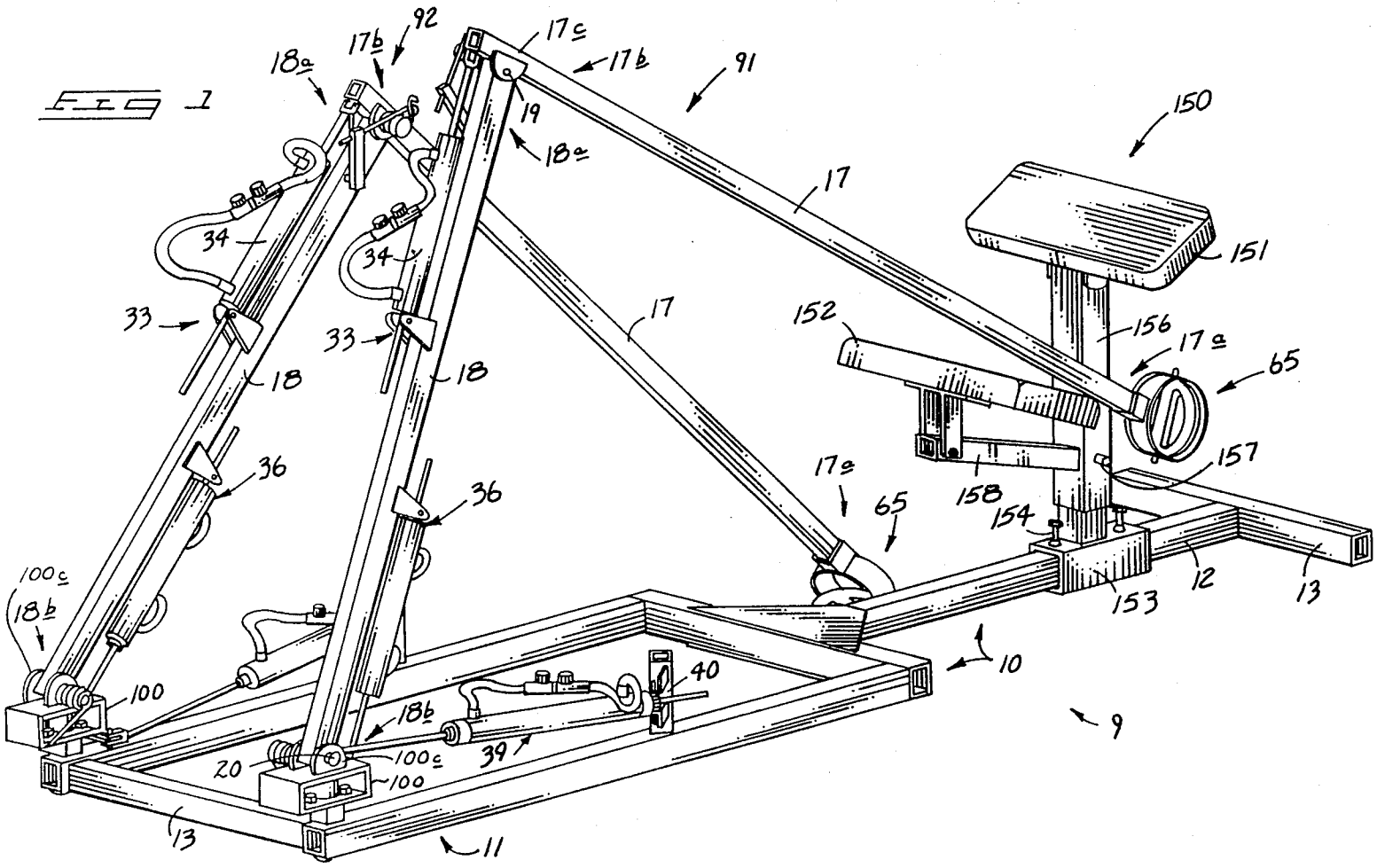
FIG. 1 is a perspective assembly view of an exerciser according to the invention.

FIG. 1 shows an isokinetic multidirectional exerciser 9 according to this invention. Exerciser 9 is capable of adjustably resisting movement in any spatial direction applied by a user engaging handgrip assemblies 65 or other points along first arms 17. The handgrip assemblies 65 can be moved elevationally, longitudinally, and transversely relative to one another and to a supporting base 10. Each handgrip assembly is movably supported by a mechanism permitting relative movement between the handgrip assembly 65 and base 10 about three independent axes.

The individual handgrip assemblies 65 are mounted at the outer ends of movable boom assemblies 91 and 92 each formed by articulated arms 17 and 18. First and second boom arms 17 and 18 are preferably elongated and have distal ends **17*a* and 18*a*, respectively. Arms 17 and 18 also have proximate ends 17*b* and 18*b*, respectively. The distal ends of first arms 17 are preferably connected to the handgrip assemblies or other body engagement means. The proximate ends of the first arms are pivotally connected to the distal ends of the second arms at a first pivot axis X—X (see FIG. 2). The proximate ends 18*b* of the second arms are pivotally connected to turntables or third boom members 100 at a second pivot axis Y—Y (see FIG. 5). The turntables are pivotally connected to base 10 about a third pivot axis Z—Z (see FIG. 4**). As shown, the first and second pivot axes are substantially parallel and the third pivot axis is perpendicular thereto.

The first pivotal connections between first members 17 and second members 18, and the second pivotal connections between second members 18 and third members 100, are preferably accomplished using pivot pins 19 and 20. Pivot pins 19 and 20 extend through pivot extension brackets **17*c* and 100*c***, respectively, which are connected to the first member and third member. Apertures near the ends of the second members and in the extension brackets receive the pivot pins therethrough.

Figure 4:
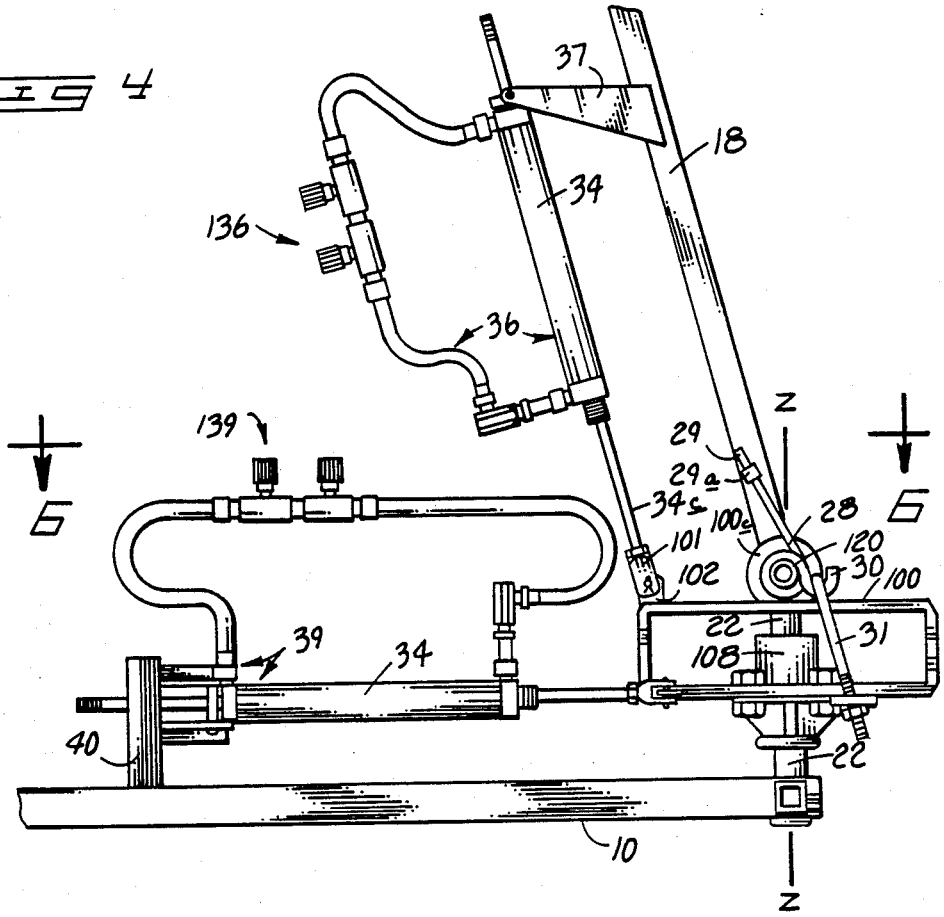
FIG. 4 is a sectional view taken along line 4—4 of FIG. 5, showing connection of a lower end of the second arm to the base.
Figure 5:
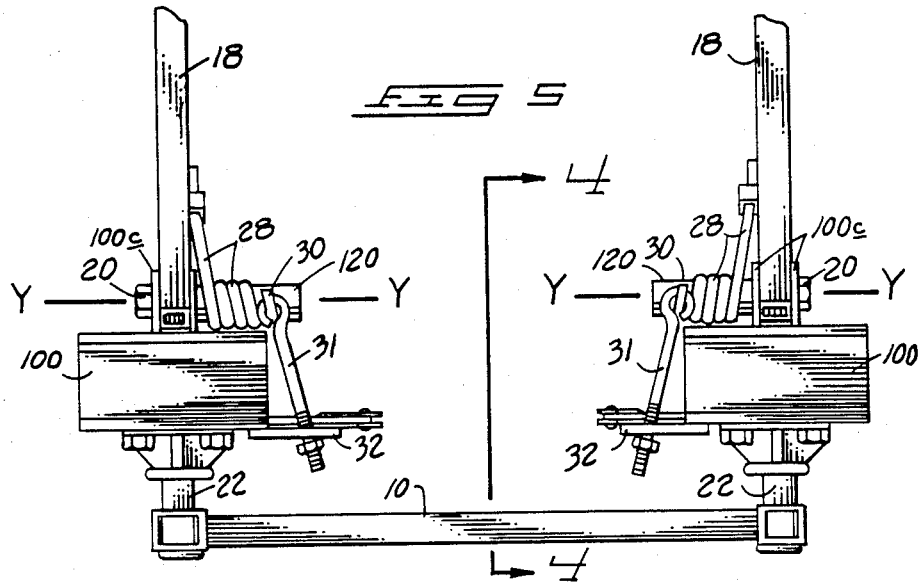
FIG. 5 is a fragmentary rear elevational view taken across the base from the left in FIG. 1.

The third member is advantageously connected to base 10 using a suitable pivotal connection. Exceriser 9 includes third pivots formed by shafts 22 (as shown in FIGS. 4 and 5) which are rigidly connected to base 10 and extend vertically upward. Journals 108 are formed by or connected to third members 100 and are received about the shaft to form suitable pivotal bearings.

Figure 2:
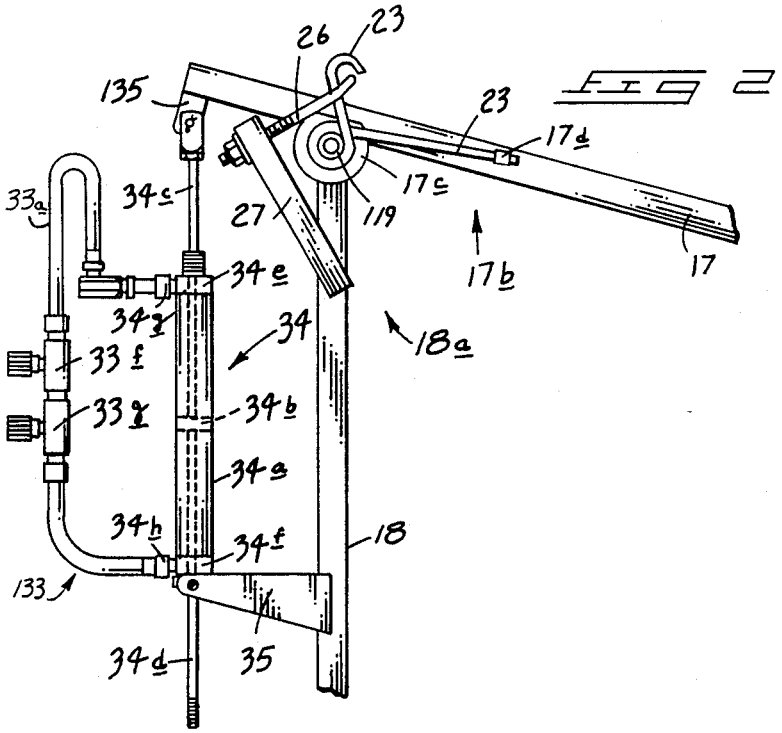
FIG. 2 is a fragmentary side elevation view showing connecting portions of the first and second arms of the exerciser of FIG. 1.

Exerciser 9 also includes resistance means 133, 136 and 139 (as shown in FIGS. 2 and 4) which operably restrain motion between the first, second and third members 17, 18 and 100 and base 10 about each of the three pivot axes X—X, Y—Y, and Z—Z. These resistance means are preferably fluid resistive systems. Exerciser 9 advantageously employs first, second and third fluid resistance assemblies 33, 36, and 39 for each boom assembly 91 and 92. The fluid resistance assemblies 33, 36, and 39 all advantageously utilize a hydraulic or other fluid cylinder assembly 34. Cylinder assemblies 34 preferably include a piston **34*b* (shown in phantom in FIG. 2) which is slidably mounted within a cylinder 34*a* in the well known structure. Rods 34*c* and 34d extend through end pieces 34*e* and 34*f* which are provided with rod seals and fluid fittings 34*g* and 34*h* which communicates fluid to either side of piston 34*b*. The opposing fluid chambers on either side of piston 34*b* communicate fluid through fittings 34*g* and 34*h* to a closed fluid flow resistance path 33*a*** connected therebetween, which will be explained more fully below.

Figure 7:
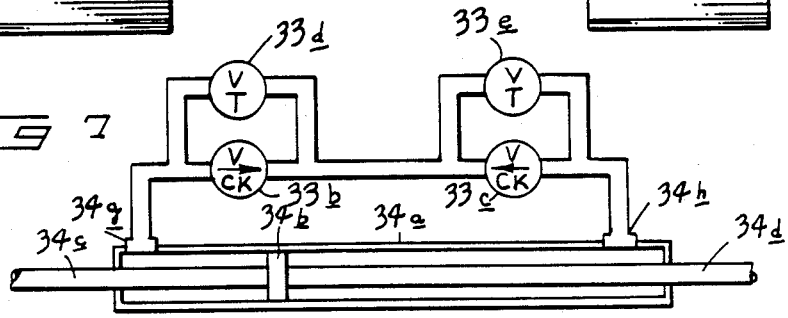
FIG. 7 is a diagrammatic view of a cylinder assembly and associated fluid resistance elements.

FIG. 7 shows a preferred closed loop fluid flow resistance means. Fittings **34*g* and 34*h* have a direct flow path extending therebetween without the need for fluid reservoir. A first check valve 33*b* and second check valve 33*c* are arranged in opposing orientation. First and second bypass metering valves 33*d* and 33*e* are connected to communicate fluid around check valves 33*b* and 33*c*. In the preferred embodiment shown the first metering valve and second check valve are advantageously embodied in one adjustable bypass check valve unit 33*f* (FIG. 2). The second metering valve and first check valve are embodied in a further adjustable bypass check valve unit 33*g* (FIG. 2**).

In operation, fluid flows from the left chamber of cylinder 34 when piston **34*b* moves to the left. This fluid flow is passed directly through check valve 33*b* but cannot pass through check valve 33*c* because of its ooposing orientation. The flowing fluid thus is forced through the second metering valve 33*e*. Conversely, flow from the right chamber of cylinder 34 passes through the second check valve 33*c* and first metering valve 33*d***. This construction allows for independent adjustment of the resistance for movement in either direction. This bidirectional adjustability allows each pivot joint to have independent resistance rates for contractional versus extensional motions.

The cylinder assemblies 34 and fluid resistance means 133 can advantageously be connected between their associated boom members in a variety of mechanical arrangements to provide the fluid resistance assemblies 33, 36, and 39. The first pivot resistance means 133 advantageously employs a pair of cylinder brackets 35 which pivotally mount the cylinder 34 to second member 18. The piston rod extending from the opposite end of the cylinder is connected to first member 17 at a point spaced from the pivot axis X—X, such as by pivotally connecting rod **34*c* to a bracket 135 mounted on an extension of arm 17**.

The second resistance means 136 yieldably resists motion about pivot axis Y—Y using fluid resistance assembly 36 which is the same as 33 (see FIG. 4). A cylinder bracket 37 is adapted to pivotally mount a cylinder 34 to second member 18. The piston rod 34c is pivotally connected to third member 100 using a clevis 101 which is longitudinally adjustable on rod **34*c*. The clevis is pivotally connected to a bracket 102 which is rigidly mounted to or form a part of third member 100**.

Figure 6:
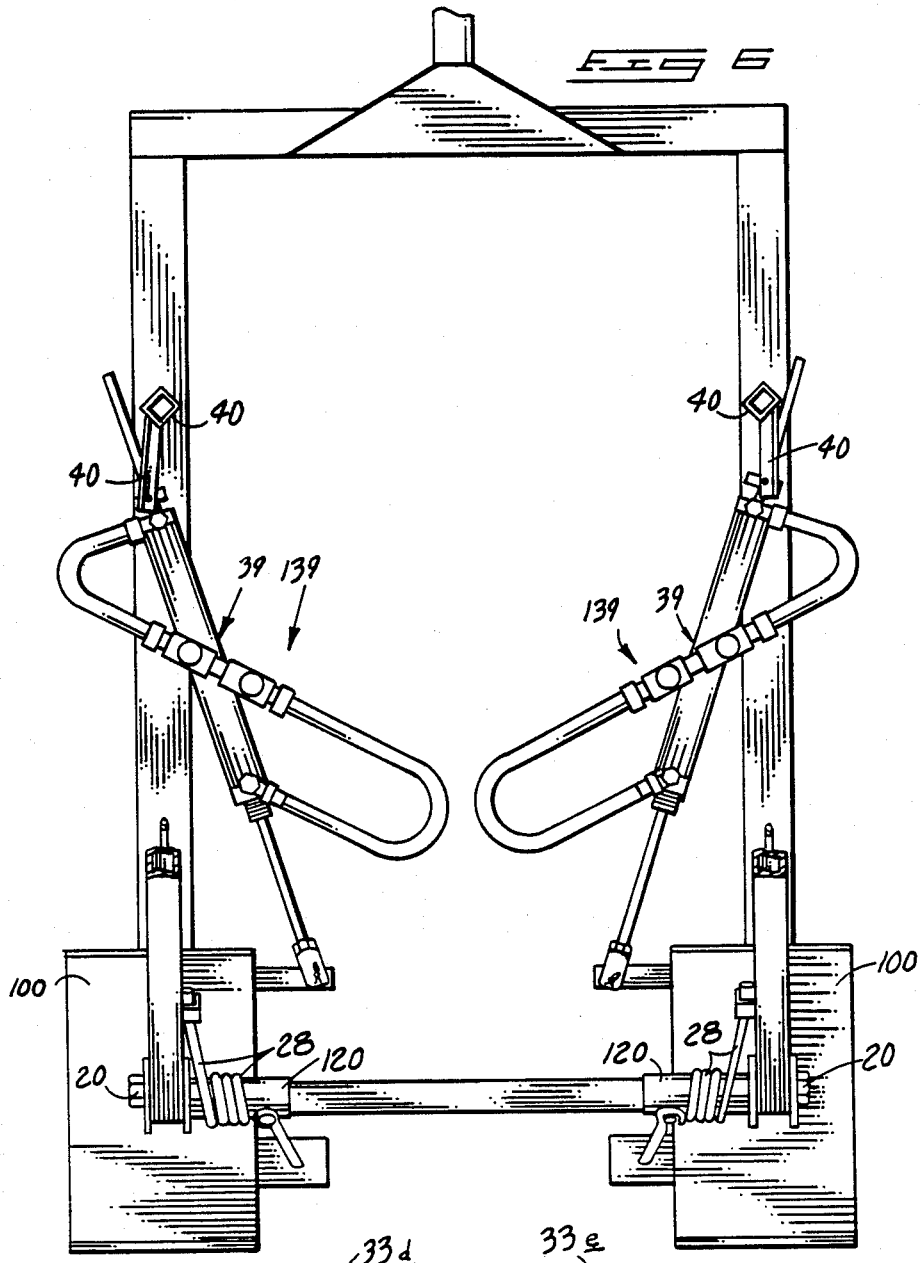
FIG. 6 is a sectional view looking downward at the base along line 6—6 in FIG. 4.

Third resistance means 139 yieldably resists motion about pivot axis Z—Z using fluid resistance assemblies 39 substantially the same as 33 (see FIGS. 4 and 6). The fluid resistance assembly 39 spans between a base bracket 40 and a suitable connection with turntable 100. The connections of the cylinder assembly with base 10 and turntable 100 are preferably pivotal.

The individual variable resistance means provided at each axis between the exerciser elements are shown as double acting hydraulic cylinders. It is to be understood that other forms of hydraulic or fluid mechanisms can be substituted, such as rotatable hydraulic units capable of reversible resistance in response to relative movement of the exerciser elements. Frictional disks, clutches or other mechanisms are also alternatively possible within the invention.

The booms are preferably counterbalances to fully or partially counteract the moments exerted about the X—X and Y—Y axes due to the weights of the booms. The Z—Z axis, as shown, is vertical to inherently preclude weight biasing into a particular turntable orientation. This construction assures that forces encountered due to movement of the boom will be the result of bodily movement imparted to it by a user, and will not be substantially affected or modified by gravitational forces associated with the boom itself. The counterbalancing helps the boom to rest in varying positions without significant drift either downwardly or upwardly.

Figure 3:
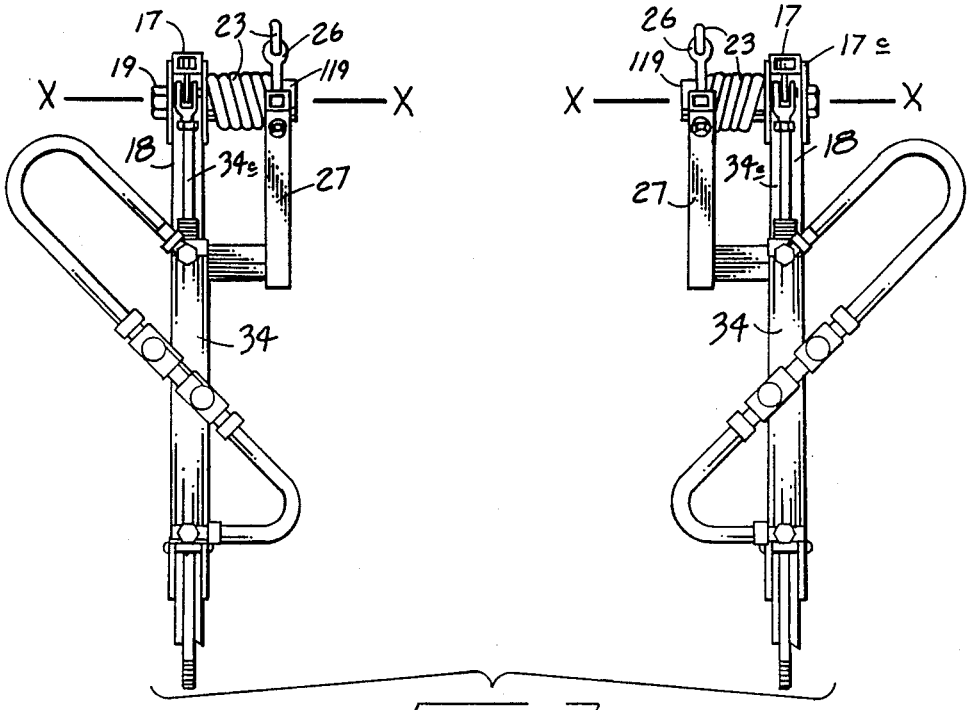
FIG. 3 is a rear elevation view of the connecting portions shown in FIG. 2, as seen from the left, both booms of the exerciser of FIG. 1 are shown.

FIGS. 2 and 3 show that the counterbalancing at the first pivot axis advantageously uses a double ended coil spring 23 which is wrapped about a spring extension shaft 119 coaxial with pivot axis X—X. Spring 23 is connected at one end to the first member using a small sleeve **17*d*. The the other end of spring 23 is connected to a spring bracket 27 which is rigidly connected to second member 18. An adjustably mounted hook 26 holds the end of the spring. Counterbalance spring 23 exerts a torque about axis X—X to counteract or neutralize the moment created about axis X—X due to the weight of the first arm 17**.

FIGS. 4, 5 and 6 show a similar counterbalance assembly provided about the second pivot axis Y—Y. Coil spring 28 is wrapped about a second spring extension pivot shaft 120. The spring includes a fixed end 29 anchored to the side of second arm 18 using a sleeve **29*a* and a free end 30 engaged by an adjustable hook 31. The hook 31 is connected to a horizontal extension 32 that protrudes outwardly from third member 100. Spring 28 counteracts the vertical forces exerted on arm 18 about the axis Y—Y due to the weight of the arms 17 and 18**.

The counterbalancing effects of springs 23 and 28 are also assisted by frictional contact at the connections forming the first and second pivots. Pivot pins 19 and 20 are preferably threaded bolts which allow the pivots to adjustably resist motion so that exact counterbalancing by springs 23 and 28 is not necessary. Adjustment is provided by advancing the pivot bolts to squeeze the members between the mounts such as proximate end **18*b* between plates 100*c* as shown in FIG. 5**. Such frictional resistances at each pivot also aid in the overall resistance of the pivots in combination with the fluid or other pivotal axis resistance means.

The booms described above are mounted on base 10 which includes a rectangular frame portion 11, an outer longitudinal extension 12, and a transverse stabilizer 13 across its front end. As used in this description, the front or user end of the exerciser shall be the end at which the user engages the relatively movable exerciser elements, and the rear or boom end shall be the end of base 10 to which the movable booms are connected.

The front end of base 10 advantageously includes a user support 150. User supports can be constructed in a variety of configurations depending upon the parts of the body being exercised and the particular muscle groups for which the novel exercisers according to this invention are designed. User support 150 is designed to support a user at a seat rest 151 and knee reset 152 thus primarily emphasizing arm and upper torso exercises to be performed with the user grasping handgrips 65. User support 150 is preferably constructed with a bracket 153 which is slidable along longitudinal base extension 12 and securable thereto using bolts 154. A stem 155 extends upwardly to adjustably mount a tubular frame extension 156 using securement means such as bolts 157. The knee rest 152 is mounted to yieldably tilt upon an outboard bracket 158. The seat rest 151 also is mounted to yieldable tilt upon frame extension 156.

While the exerciser is illustrated as a floor supported device having elements movable when gripped by one or both hands of a user seated upon the base 10, it is to be understood that the components of the exerciser can be embodied in many different physical structures and that the movable elements can be engaged by other portions of the body, such as the feet, torso, or head. The exerciser can be supported on any available supporting surface, including upright walls, ceiling structures, and various forms of rigid frames.

FIGS. 8–10 show details of a pivotably handgrip assembly 65 which is advantageously utilized at the outer ends of first arms 17. Each handgrip assembly 65 includes a transverse bar 50 extending across an encircling inner ring 51. Inner ring 51 is mounted for pivotal and rotational motion within an outer ring 55 using three guide rollers 56 which are rotatably mounted to outer ring 55 using bolt **56*a* (FIG. 10). The guide rollers have edges which axially restrain the inner ring, such as the flutes 56*b*** as shown.

The outer ring 55 is mounted to a yoke 52 to permit rotation about an outer ring axis which is preferably perpendicular to the rotational axis of inner ring 51. The inner end of yoke 52 is pivotably connected to the outer end of first arm 17 by a pivot connection 53 having a pivot axis which is advantageously parallel to the arm 18 and preferably perpendicular to the pivot axis of outer ring 55 with respect to yoke 52. The three independent axes of handgrip 65 allow bar 50 to be grasped by the user's hand and maintained in a comfortable range for a wide variety of hand, arm and body positions.

It is to be understood that other types of grips or devices adapted to be engaged by the body of a user can be substituted at the outer ends of arm 18 as required by any particular application of the exerciser. For instance, foot pedals (not shown) can be mounted to the booms to accommodate pushing and pulling movement of the feet. Alternatively, head pieces (not shown) can be used to allow easy application of force using the head. Others are also clearly possible and within the invention.

Figure 12:
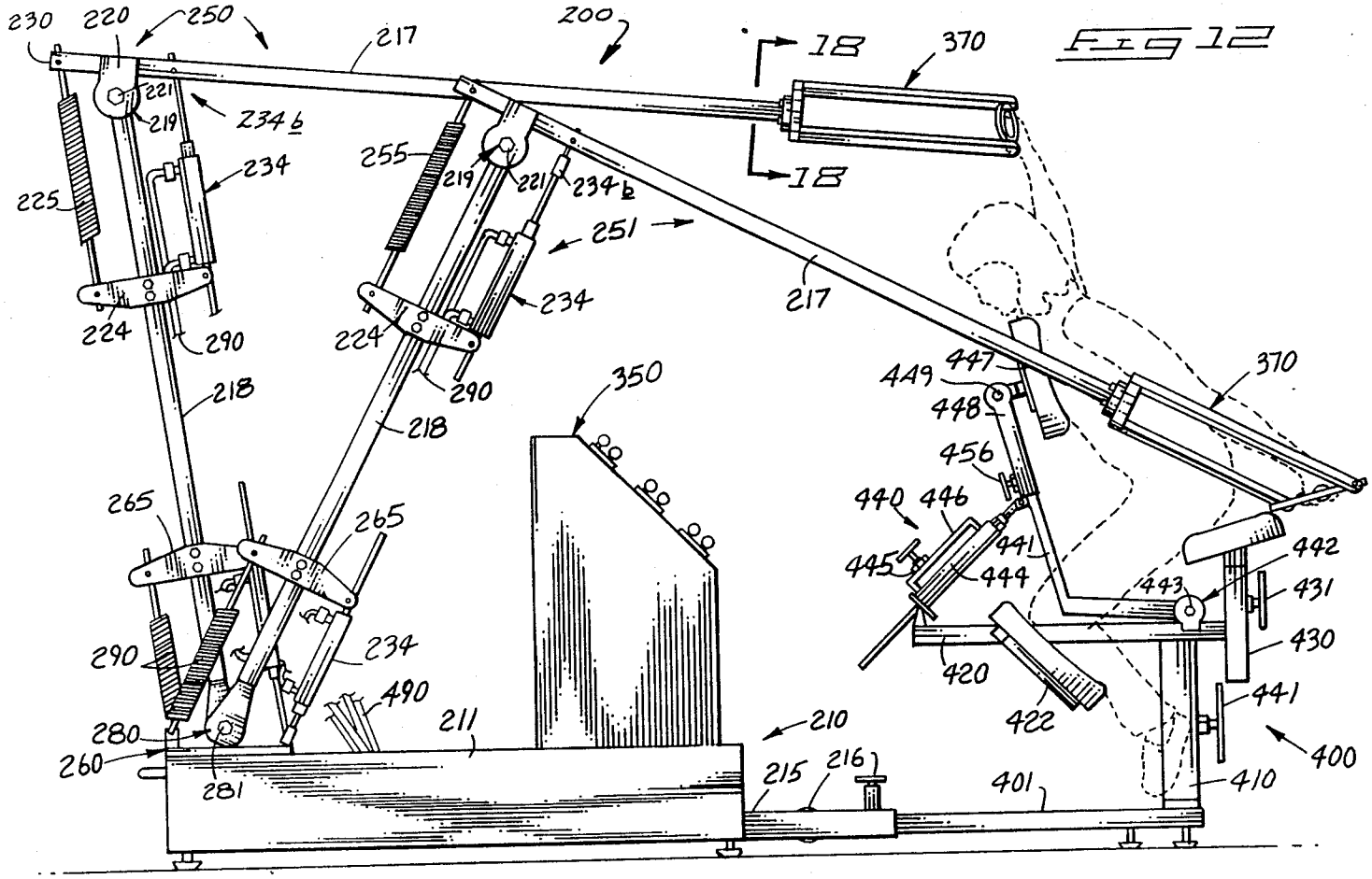
FIG. 12 is a side elevational view of a further preferred embodiment according to this invention.

FIG. 12 shows an alternative embodiment exerciser 200 according to the invention. Exerciser 200 includes a base 210 and connected booms 250 and 251. Each boom includes a first arm 217 and second arm 218 in a configuration similar to exerciser 9. The first arms 217 are connected to the second arms 218 at a first pivot axis 219 using extensions 220 and pivot bolts 221. Two transverse mounting pieces 224 are rigidly connected to second member 218 in a parallel arrangement and are used to mount a resistance means and a counterbalancing helical extension spring 225. The spring is mounted between a cantilevered portion 230 of first arm 217 and mounting piece 224. The opposite side of mounting piece 224 is used to mount a cylinder of a cylinder assembly 234 similar in construction to cylinder assembly 34 described above. The opposite piston rod end of cylinder assembly 234 is connected to first arm 217, preferably using a threaded adjustment coupling **234*b*. The counterbalancing spring 225 and cylinder 234** are both mounted at each end using pivotable connections.

The second arm 218 is pivotally connected to a third turntable member 260 at a second pivot axis 280 using a pivot shaft bolt 281. The first and second pivot axes are advantageously parallel thus allowing motion within a plane in any desired direction using pivotal motion about such first and second pivots. The second arm is advantageously provided with parallel second transverse mounting pieces 265 similar to 224 for mounting a second resistance means and counterbalancing spring between the second and third boom members 218 and 260. The resistance means is advantageously a fluid resistance cylinder assembly 234 as described above which is connected in a similar fashion. A second pivot counterbalance spring 290 extends between the mounting piece 265 and third member 260 opposite to the movement of resistance means 234.

Figure 14:
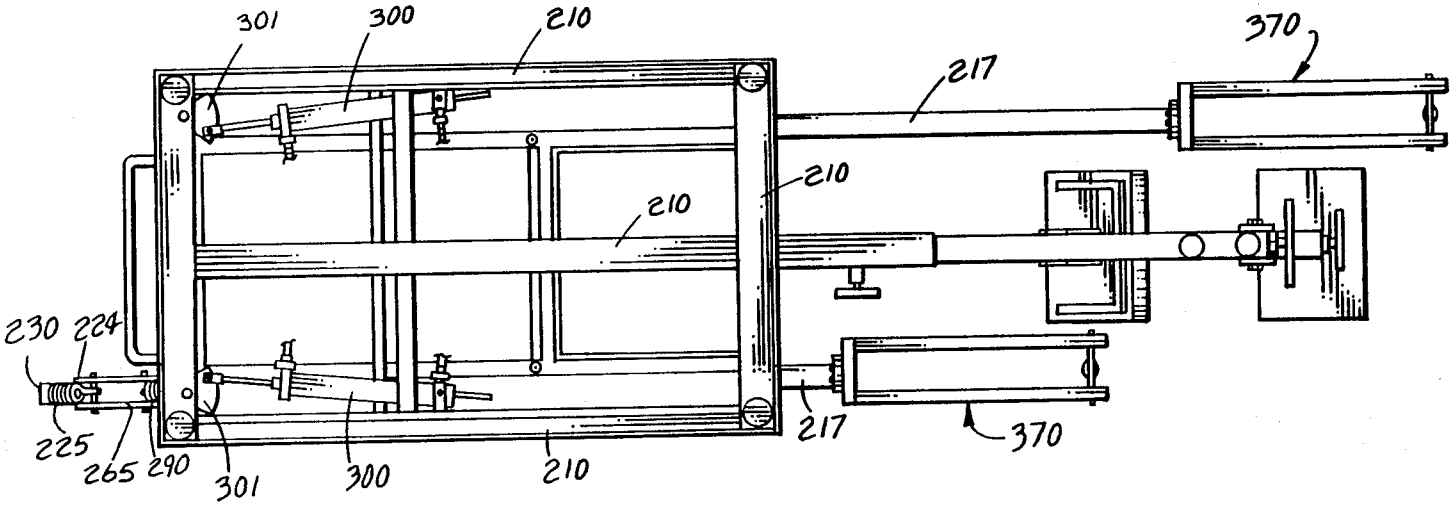
FIG. 14 is a bottom view of the exerciser of FIG. 12.

The third or turntable member 260 is mounted for pivotal motion about a vertical third pivot axis which preferably intersects the second pivot axis and is perpendicular thereto. Third resistance means 300 (FIG. 14) are pivotally connected to base 210 and lever arms 301 of turntable 260 extending within the base shroud 211. Resistance means 300 are preferably fluid resistance means constructed and connected such as 33 and 234 described above.

Figure 13:
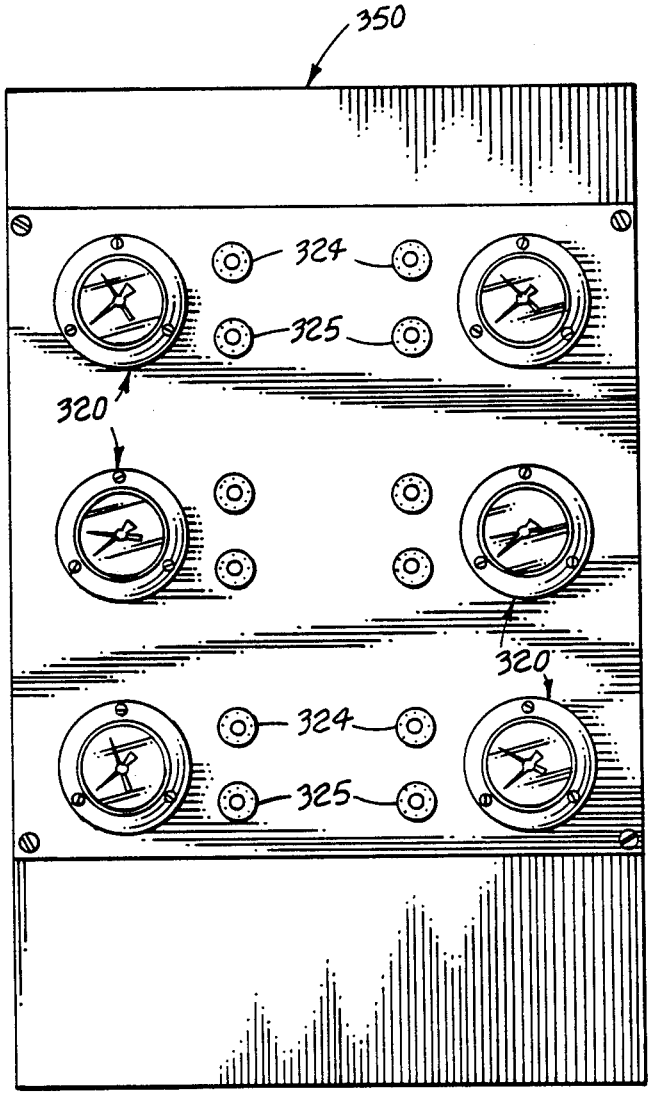
FIG. 13 is an isolated plan view of a preferred control panel used in the exerciser of FIG. 12, viewed along a line of sight perpendicular to the face of the control panel.

The resistance means 234 and 300 are preferably connected in a hydraulic flow scheme as shown in FIG. 15. This arrangement is similar to the resistance flow assembly described above with respect to FIG. 7 except a pressure gauge 320 has been connected between the opposing check valves 321 and 322. The bypass metering valves 324 and 325 are arranged to allow flow around each check valve 321 and 322. The gauge and metering valves for each of the six fluid resistance means are preferably mounted on a control panel 350 which extends upwardly from base 210 so as to provide clear visibility to the user. Control panel 350 is shown in plan view in FIG. 13 with six gauges 320 and six sets of easily accessible metering valves 324 and 325 for each fluid resistive means. The gauges 320 advantageously include a recording needle to show maximum force applied.

FIG. 16 shows an alternative fluid resistance means which is electronically controlled to provide varying resistance dependent upon the relative position of the first, second and third members of the boom. Position sensors 400 of any suitable type, such as a variable resistance wiper, are connected to detect the relative position of each boom member at each pivot axis. The information indicating position is fed into a microprocessor or computer 410 which has been preprogrammed to provide a varying resistance as desired dependent on boom member position. Variation of exerciser resistance can also be a function of other parameters such as biofeedback from cardiac or other user sensors 450 or as a function of time. The computer then controls the bypass metering valves 430 and 431 using solenoid actuators **430*a* and 431*a*** to vary the resistance experienced by the user as desired and preprogrammed. Using such a system the resistance can be effectively controlled for any desired orientation or direction of motion.

Figure 17:
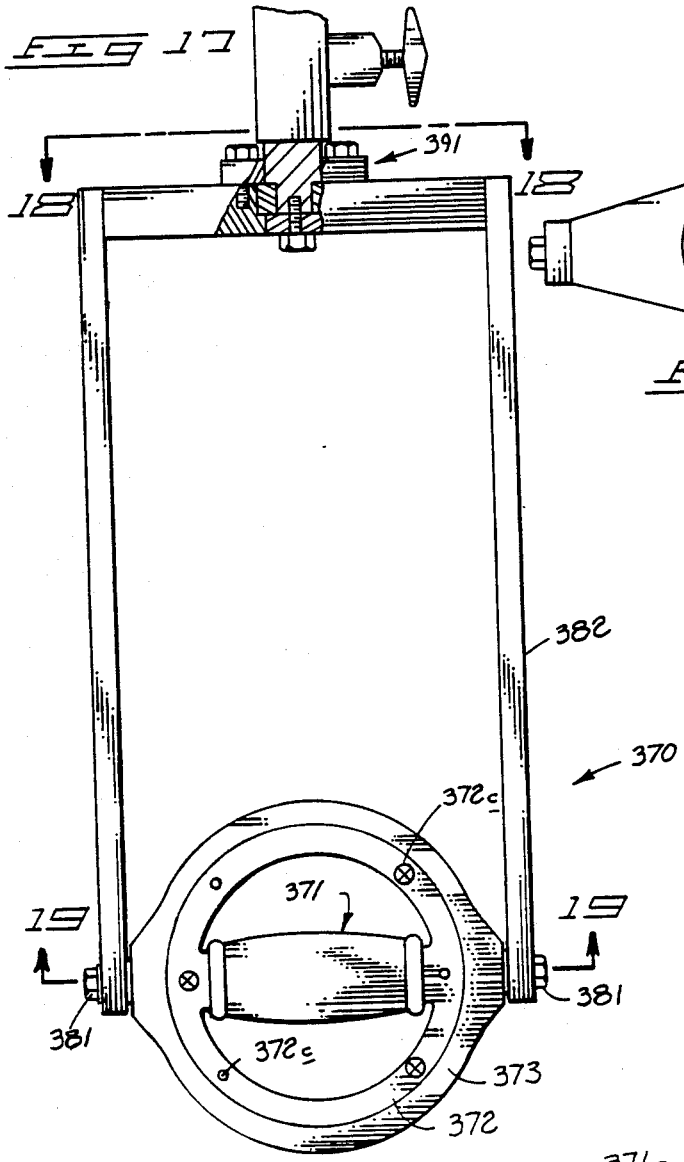
FIG. 17 is a plan view showing a preferred form of hand grip used in the embodiment of FIG. 12.
Figure 18:
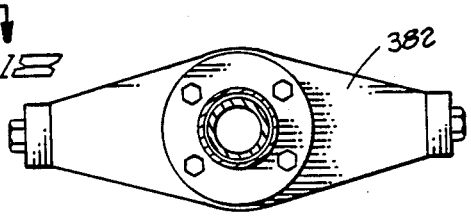
FIG. 18 is a sectional view taken along line 18—18 in FIG. 17.
Figure 19:
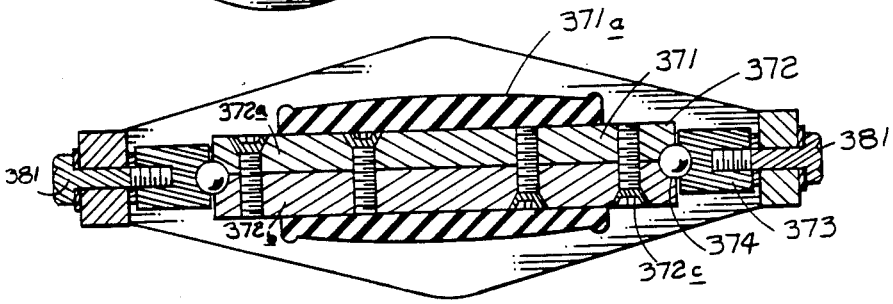
FIG. 19 is an enlarged sectional view taken along line 19—19 in FIG. 17.

Exerciser 200 also advantageously uses a gimballed 3-axis handgrip 370 similar to handgrips 65. Handgrips 370 include a grip bar 371 (FIGS. 17–19) which is advantageously covered with an elastomeric grip pad 371*a*. The grip bar is mounted to an inner ring 372 which is pivotally mounted within an outer ring 373 using ball bearings 374 arranged within races upon each ring. The inner ring rotates about a grip pivot axis. The inner ring is advantageously split into halves 372*a* and 372*b* and connected by screws 372*c* which allow installation of the inner ring and bearing within outer ring 373.

The handgrips 370 also have a ring pivot axis defined by pivot bolts 381 which extend through apertues in a yoke 382 and connect to outer ring 373. The ring pivot axis is perpendicular to the grip pivot axis.

The yoke 382 has two arms which are preferably elongaged to a length slightly longer than the user's forearm to allow extension of the arm therein. The yoke is mounted for pivotal motion relative to the first boom arm at pivot coupling 391 or other suitable bearing. Pivot coupling 391 allows rotation about a yoke pivot axis which is preferably perpendicular to the ring pivot axis.

Exerciser 200 further includes a user support 400 which advantageously includes a longitudinal extension 401 which is telescopically received within a tubular extension 215 of base 210. The position of extension 401 within tube 215 can be fixed using bolts 216 which are advantageously provided with oversize circular heads for easy manipulation.

The user support also includes a telescoping stem 410 secured in position with securement 411. The stem 410 supports a longitudinal beam 420 which mounts two knee rests 422, a telescopically adjustable seat 430 and a torso support-exerciser 440. The knee rests 422 are rigidly connected to beam 420. The seat rest is secured using bolt 431.

The torso support-exerciser 440 includes a main bar 441 which is pivotally connected to beam 420 at pivot 442. The pivot can be tightened by tightening pivot bolt 443 as described above for pivots 19 and 20. A double-acting fluid cylinder 444 is pivotally connected to the main bar 441 at an intermediate position, and to the beam 420. A valve 445 allows cylinder to be fixed in a desired, adjustable position when closed. Valve 445 can also allow fluid to flow through conduit 446 between opposing chambers of cylinders 444 to allow pivotal motion of bar 441 about pivot 442. Chest pad 447 can thus be moved upwardly or downwardly in an arcuate motion using the chest to provide an additional mode of exercise. The chest pad is advantageously connected to a telescoping chest pad tube 448 to pivot 449. The pivotal action at 449 and the adjustable securing bolt 450 allow a variety of chest heights and contours to be accommodated.

The exerciser 200 is used by setting a desired resistance at each of the six pivot controls 324, 325 on control panel 350. The user then positions herself in a desired position, such as shown in FIG. 12 using user support 400. The user then grasps the handgrips 370 and manipulates the grips and connected booms in any desired direction. Fluid pressure generated in the resisting cylinders is conveyed through hoses 490 connected between the cylinders and the control valves 324, 325 and associated check valves 321 and 322 mounted in control panel 350. Pressure gauges 320 can easily be viewed to give the user an indication of force being applied. Exercising can be performed using either linear, curvilinear or complex motions in either a plane or three dimensions using exerciser 200.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. An exerciser for resisting movement in any direction as applied by contacting parts of a user's body, comprising:
   - a base;
   - an elongated first member having a distal end adapted for engagement by the user, and a proximate end longitudinally spaced from said distal end;
   - an elongated second member which is operably connected for pivotal movement relative to the first member about a first pivot axis;
   - a third member which is operably connected for pivotal movement relative to the second member about a second pivot axis; said third member further being operably connected for pivotal movement relative to said base about a third pivot axis;
   - said first, second and third members and said base being pivotally connected to allow the first member to move in any desired direction throughout at least a portion of the first member's range of motion;
   - first resistance means operably connected between the first and second members for resisting pivotal movement about said first pivot axis;
   - second resistance means operably connected between the second and third members for resisting pivotal movement about said second pivot axis; and
   - third resistance means operably connected between the third member and base for resisting pivotal movement about said third pivot axis.

2. The exerciser of claim 1 wherein at least one of said resistance means is adjustable to vary resistance to movement.

3. The exerciser of claim 2 wherein a plurality of said resistance means are adjustable.

4. The exerciser of claim 2 wherein all of said resistance means are adjustable.

5. The exerciser of claim 1 wherein at least one of said resistance means is bidirectionally adjustable to independently vary resistance to movement dependent upon the direction of such movement.

6. The exerciser of claim 5 wherein a plurality of said resistance means are bidirectionally adjustable.

7. The exerciser of claim 5 wherein all of said resistance means are bidirectionally adjustable.

8. The exerciser of claim 1 wherein at least one of said resistance means is a fluid containing system.

9. The exerciser of claim 1 wherein at least one of said resistance means is a fluid containing system having variable flow resistance.

10. The exerciser of claim 5 wherein at least one of said resistance means is a fluid containing system having variable flow resistance.

11. The exerciser of claim 9 wherein at least one of said resistance means includes a closed loop which passes fluid from one side of a movable element to another side thereof.

12. The exerciser of claim 1 further comprising at least one counterbalance means for counteracting force due to weight of at least one member.

13. The exerciser of claim 12 wherein the counterbalance means is adjustable.

14. The exerciser of claim 12 wherein the counterbalance means is a spring.

15. The exerciser of claim 1 wherein two of said pivot axes are parallel.

16. The exerciser of claim 1 wherein two of said pivot axes are parallel and a remaining non-parallel pivot axis of said pivot axes is orthogonal to the parallel pivot axes.

17. The exerciser of claim 1 wherein two of said pivot axes are parallel and a remaining non-parallel pivot axis of said pivot axes is orthogonal to the parallel pivot axes; and further comprising at least one counterbalance means for counteracting force due to weight of at least one member.

18. The exerciser of claim 1 wherein said first member is provided with an engagement part adapted for engagement by extremities of the user.

19. The exerciser of claim 18 wherein the engagement part is a grip.

20. The exerciser of claim 18 wherein the engagement part is a hand grip having at least one degree of freedom for movement relative to said first member.

21. The exerciser of claim 1 further comprising an engagement part adapted for engagement by the user to move at least one of said members.

22. The exerciser of claim 21 wherein the engagement part includes at least one degree of freedom for movement relative said first member.

23. The exerciser of claim 22 wherein the engagement part is provided with at least two pivotal axes.

24. The exerciser of claim 22 wherein the engagement part is gimballed using three pivotal axes.

25. The exerciser of claim 1 further comprising a user support connected to said base.

26. The exerciser of claim 25 wherein said user support includes a seat and knee rest.

27. The exerciser of claim 26 wherein said user support further includes a chest rest.

28. The exerciser of claim 25 wherein the user support is adjustable.

29. The exerciser of claim 1 wherein there are a plurality of articulated booms each having said first, second and third members.

30. The exerciser of claim 1 further comprising preprogrammable control means for adjustably varying resistance of at least one of said resistance means according to at least one preprogrammed parameter.

31. The exerciser of claim 30 wherein the control means varies resistance dependent upon the relative position of the members.

32. A multidirectional exerciser for resisting movement applied by a user in various directions, comprising:

a first member;

a second member pivotally connected to said first member about a first pivot axis;

a third member pivotally connected to said second member about a second pivot axis spaced from said first pivot axis;

first adjustable resistance means for resisting movement of said first member relative to said second member about said first pivot axis; and second adjustable resistance means for resisting movement of said second member relative to said third member about said second pivot axis; and at least one counterbalance means for counteracting force due to weight of at least one of said members.

33. The exerciser of claim 32 wherein said first and second adjustable resistance means includes a fluid displacing means movable within a chamber to displace fluid therefrom and an adjustable fluid resistance means for controllably varying the resistance experienced by the user.

34. The exerciser of claim 33 further defined to include a closed loop which conveys fluid displaced from a first side of the fluid displacing means to a second side of the fluid displacing means.

35. The exerciser of claim 32 wherein at least one of said first and second adjustable resistance means includes:

a fluid displacing piston within a cylinder;

fluid at both sides of said piston within said cylinder;

fluid conveying means connected between said sides of said piston;

adjustable fluid resisting means for controllably resisting flow of fluid between said sides of the piston.

36. The exerciser of claim 33 further comprising bidirectionally adjustable fluid resistance means.

37. A multidirectional handgrip for use with multidirectional exercisers; comprising:

a yoke adapted for connection to a first member of a multidirectional exerciser so as to allow free rotation about a yoke pivot axis; said yoke having two elongated arms which are spaced apart and of sufficient length to allow the forearm of a user to extend within the yoke when said handgrip is properly gripped by a hand of the user;

an outer ring pivotally connected between the two arms of the yoke for pivotal motion about a ring pivot axis which is perpendicular to said yoke pivot axis;

an inner ring rotatably mounted at least partially within the outer ring for rotation about a grip pivot axis which is perpendicular to said ring pivot axis.

38. An exerciser for resisting movement of a user's body, comprising:

a base;

a first member adapted for engagement by the user;

a second member which is oeprably connected to the first member for pivotal motion about a first pivot axis;

a third member which is operably connected to the second member for pivotal motion about a second pivot axis; said third member also being operably connected to the base for pivotal motion about a third pivot axis;

first resistance means operably connected between the first and second members for resisting pivotal movement about said first pivot axis;

second resistance means operably connected between the second and third members for resisting pivotal movement about said second pivot axis; and third resistance means operably connected between the third member and base for resisting pivotal movement about said third pivot axis.

39. The exerciser of claim 38 wherein at least one of said resistance means is adjustable to vary resistance to movement.

40. The exerciser of claim 38 wherein at least one of said resistance means is bidirectionally adjustable to independently vary resistance to movement dependent upon the direction of such movement.

41. The exerciser of claim 38 wherein at least one of said resistance means is a fluid containing system.

42. The exerciser of claim 38 wherein at least one of said resistance means is a fluid containing system having variable flow resistance.

43. The exerciser of claim 38 wherein at least one of said resistance means includes a closed loop which passes fluid from one side of a movable element to another side thereof.

44. The exerciser of claim 38 further comprising at least one counterbalance means for counteracting force due to weight of at least one member.

45. The exerciser of claim 44 wherein the counterbalance means is adjustable.

46. The exerciser of claim 44 wherein the counterbalance means is a spring.

47. The exerciser of claim 38 wherein two of said pivot axes are parallel.

48. The exerciser of claim 38 wherein two of said pivot axes are parallel and a remaining non-parallel pivot axis of said pivot axes is orthogonal to the parallel pivot axes.

49. The exerciser of claim 38 wherein two of said pivot axes are parallel and a remaining non-parallel pivot axis of said pivot axes is orthogonal to the parallel pivot axes; and further comprising at least one counterbalance means for counteracting force due to weight of at least one member.

50. The exerciser of claim 38 wherein said first member is provided with an engagement part adapted for engagement by the user.

51. The exerciser of claim 50 wherein the engagement part is a grip.

52. The exerciser of claim 50 wherein the engagement part is a hand grip having at least one degree of freedom for movement relative to said first member.

53. The exerciser of claim 38 further comprising a user support connected to said base.

54. The exerciser of claim 53 wherein said user support includes a seat and knee rest.

55. The exerciser of claim 54 wherein said user support further includes a chest rest.

56. The exerciser of claim 53 wherein the user support is adjustable.

57. The exerciser of claim 38 further comprising preprogammable control means for adjustably varying resistance of at least one of said resistance means according to at least one preprogrammed parameter.

58. The exerciser of claim 38 wherein the control means varies resistance dependent upon the relative position of the members.

59. An exerciser for resisting movement of a user's body, comprising:

a base; and at least two articulated booms;

at least two of said articulated booms comprising:

a first member adapted for engagement by the user;

a second member which is operably connected to the first member for pivotal motion about a first pivot axis;

a third member which is operably connected to the second member for pivotal motion about a second pivot axis; said third member also being operably connected to the base for pivotal motion about a third pivot axis;

first resistance means operably connected between the first and second members for resisting pivotal movement about said first pivot axis;

second resistance means operably connected between the second and third members for resisting pivotal movement about said second pivot axis; and third resistance means operably connected between the third member and base for resisting pivotal movement about said third pivot axis.

60. An exerciser for resisting movement in various directions within a plane of motion as applied by contacting parts of a user's body, comprising:

a base;

a first member adapted for engagement by the user;

a second member which is operably connected to the first member for pivotal motion about a first pivot axis; said second member also being operably connected to said base for pivotal motion about a second pivot axis parallel to said first pivot axis;

first resistance means operably connected between the first and second members for resisting pivotal movement about said first pivot axis;

second resistance means operably connected between the second member and the base for resisting pivotal movement about said second pivot axis;

at least one of said resistance means including bidirectionally adjustable fluid resistance means to provide adjustable fluid flow resistance therethrough in either of two directions between first and second sides of a fluid displacing means, including first check valve means oriented to allow fluid flow from said first side to said second side of the fluid displacing means, a second check valve means oriented to allow fluid flow from said second side to said first side of the fluid displacing means; a first adjustable bypass valve means connected in parallel with said first check valve means; a second adjustable bypass valve means connected in parallel with said second check valve means.

61. The exerciser of claim 60 and further comprising preprogrammable control means for adjustably varying resistance of at least one of said resistance means according to at least one preprogrammed parameter.

62. The exerciser of claim 60 wherein both of said first and second resistance means include said bidirectionally adjustable fluid resistance means.

63. The exerciser of claim 60 further comprising at least one counterbalance means for counteracting force due to weight of at least one of said members.

* * * * *